US012679623B2

(12) United States Patent
Funaki et al.

(10) Patent No.: US 12,679,623 B2
(45) Date of Patent: Jul. 14, 2026

(54) PACKING MEMBER AND PACKING MATERIAL THEREWITH

(71) Applicant: KYOCERA Document Solutions Inc., Osaka (JP)

(72) Inventors: Keiichi Funaki, Osaka (JP); Atsushi Itano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/078,928

(22) Filed: Mar. 13, 2025

(65) Prior Publication Data

US 2025/0313395 A1 Oct. 9, 2025

(30) Foreign Application Priority Data

Apr. 4, 2024 (JP) ..... 2024-060907

(51) Int. Cl.
*B65D 81/05* (2006.01)
*B65D 81/133* (2006.01)

(52) U.S. Cl.
CPC ..... *B65D 81/055* (2013.01); *B65D 81/133* (2013.01)

(58) Field of Classification Search
CPC .. B65D 81/053; B65D 81/113; B65D 81/025; B65D 81/055; B65D 81/133; B65D 81/05; B65D 81/127; B65D 2585/689; Y02W 30/80
USPC ..... 206/591–592, 424, 586, 521, 523, 594, 206/587, 453, 589, 600, 1.5, 232, 316.1, 206/413, 588; 229/147, 154, 167, 103.2, 229/122, 174, 939, 120.02, 132, 169; 217/35, 53
See application file for complete search history.

(56) References Cited

U.S. PATENT DOCUMENTS 2,132,957 A * 10/1938 Mahone ..... B65D 5/2004 229/122.34
2,684,758 A * 7/1954 Aquino ..... B65D 5/5002 206/349

(Continued)

FOREIGN PATENT DOCUMENTS

CN 116620716 A * 8/2023 ..... B65D 77/26
DE 20318803 U1 * 3/2004 ..... B65D 81/054

(Continued)

OTHER PUBLICATIONS

Extended European Search Report dated Jul. 30, 2025, issued by the European Patent Office in corresponding application EP 25165892.8.

*Primary Examiner* — Orlando E Aviles
*Assistant Examiner* — Brijesh V. Patel
(74) *Attorney, Agent, or Firm* — Stein IP, LLC

(57) ABSTRACT

A packing member includes a body portion and a shock absorbing member. The body portion includes a bottom face portion that is rectangular in shape and on which a packed article is placed, and a side face portion that is provided continuously with the bottom face portion via folding lines along its three sides. The body portion is assembled by folding a piece of sheet. The shock absorbing member is disposed along one side of the body portion along which the side face portion is not provided continuously with it. The shock absorbing member has a holding structure that keeps the side face portion upright relative to the bottom face portion.

7 Claims, 4 Drawing Sheets

(56) References Cited

U.S. PATENT DOCUMENTS 2,924,371 A * 2/1960 Frankenstein ..... B65D 5/2009 229/174
2,979,246 A * 4/1961 Liebeskind ..... B65D 5/509 229/185.1
3,219,256 A * 11/1965 Zastrow ..... B65D 5/0245 206/424
3,261,537 A * 7/1966 Kistner ..... B65D 5/665 206/424
3,263,897 A * 8/1966 Giroux ..... B65D 5/0245 206/434
3,266,705 A * 8/1966 Wood ..... B65D 81/1275 229/152
3,289,824 A * 12/1966 Boitel ..... B65D 5/0245 206/424
3,325,964 A * 6/1967 Boitel ..... B65D 5/0245 206/424
3,368,735 A * 2/1968 Levi ..... B65D 5/0245 206/424
3,445,051 A * 5/1969 Goldman ..... B65D 5/56 206/521
3,722,668 A * 3/1973 Carpenter ..... B65D 5/2009 206/424
3,768,721 A * 10/1973 Carpenter ..... B65D 5/0245 206/424
3,790,065 A * 2/1974 Carpenter ..... B65D 5/0245 206/424
3,792,811 A * 2/1974 Carpenter ..... B65D 5/0245 206/427
3,820,708 A * 6/1974 Sieffert ..... B65D 5/0245 206/424
3,820,709 A * 6/1974 Sieffert ..... B65D 5/0245 206/424
3,836,066 A * 9/1974 Del Priore ..... B65D 5/5023 206/424
3,894,632 A * 7/1975 Sieffert ..... B65D 5/5016 206/424
3,895,712 A * 7/1975 Sieffert ..... B65D 5/5016 206/424
3,957,196 A * 5/1976 Kellerman ..... B65D 5/5033 206/326
4,008,804 A * 2/1977 Poggiali ..... B65D 5/5054 206/583
4,119,202 A * 10/1978 Roth ..... B65D 71/0014 229/164
4,162,729 A * 7/1979 Kaiser ..... B65D 5/5028 206/592
4,265,393 A * 5/1981 Orchard ..... B65D 5/6652 229/160
4,360,145 A * 11/1982 Wilcox ..... B65D 81/107 206/521
4,398,212 A * 8/1983 Serry ..... H04N 17/04 348/E17.005
4,545,482 A * 10/1985 Novatny ..... B65D 81/107 206/320
4,606,460 A * 8/1986 Luray ..... B65D 81/07 206/583
4,709,817 A * 12/1987 Keady ..... B65D 81/107 206/592
4,826,074 A * 5/1989 DePaul ..... B65D 5/542 229/905
4,858,414 A * 8/1989 Meschi ..... B65D 5/68 206/215
5,002,188 A * 3/1991 Dickie ..... B65D 5/5021 229/120.21
5,226,542 A * 7/1993 Boecker ..... B65D 81/07 206/583
5,398,808 A * 3/1995 Chen ..... B65D 5/5071 206/320
5,522,504 A * 6/1996 Levi ..... B65D 75/14 206/424
5,615,795 A * 4/1997 Tipps ..... B65D 5/566 206/523
5,692,618 A * 12/1997 Beak ..... B65D 5/5088 206/592
5,772,025 A * 6/1998 Chen ..... B65D 81/05 206/320
5,823,352 A * 10/1998 Mena ..... B65D 5/4204 206/721
5,934,473 A * 8/1999 Belshe ..... B65B 61/20 206/583
6,155,419 A * 12/2000 Sowa ..... B65D 75/004 206/320
6,268,039 B1 * 7/2001 Chou ..... B65D 5/5069 206/583
6,340,087 B1 * 1/2002 Bridges ..... B65D 81/05 206/592
6,557,706 B2 * 5/2003 Bowers ..... B65D 5/5004 206/703
6,569,073 B1 * 5/2003 Bridges ..... B65B 5/108 493/260
6,644,476 B2 * 11/2003 Wu ..... B65D 81/05 206/586
6,986,456 B2 * 1/2006 Jone ..... B65D 5/643 229/117.11
7,017,738 B2 * 3/2006 Russo ..... B65D 5/504 206/320
7,458,465 B1 * 12/2008 Dahl ..... B65D 81/107 206/592
7,588,148 B2 * 9/2009 Yang ..... B65D 5/509 206/592
7,896,159 B2 * 3/2011 Goda ..... B65D 81/056 206/386
7,946,426 B2 * 5/2011 Ohsawa ..... B65D 81/056 206/586
8,016,109 B2 * 9/2011 Liang ..... B65D 81/05 206/521
8,256,620 B2 * 9/2012 Kiessner ..... B65D 5/5004 229/179
8,256,621 B2 * 9/2012 Deiger ..... B65D 71/10 206/600
8,807,338 B2 * 8/2014 Moring ..... B65D 81/113 206/459.5
9,199,761 B2 * 12/2015 McDonald ..... B65D 81/05
9,233,787 B2 * 1/2016 Nakamura ..... B65D 81/055
9,334,092 B2 * 5/2016 Panzica ..... B65B 13/00
9,932,162 B2 * 4/2018 Stack, Jr. ..... B65D 5/5016
10,035,638 B1 * 7/2018 LeRoy ..... B65D 5/6652
11,161,669 B2 * 11/2021 Tsunashima ..... B65D 81/058
2001/0022319 A1 9/2001 Chevalier ..... 229/136
2002/0179469 A1 * 12/2002 Tomnga ..... B65D 81/056 206/320
2005/0121356 A1 * 6/2005 Wisecarver ..... B65D 19/385 206/586
2006/0219596 A1 * 10/2006 Lin ..... B65D 81/113 206/592
2008/0054057 A1 * 3/2008 Chang ..... B65D 5/22 229/120.02
2009/0065385 A1 * 3/2009 Kakuta ..... B65D 81/113 206/588
2012/0043249 A1 * 2/2012 Tsukii ..... B65D 81/05 206/521
2023/0015782 A1 * 1/2023 Fischhuber ..... B65D 5/002
2023/0146687 A1 * 5/2023 Nemoto ..... B65D 81/025 206/521
2024/0317454 A1 * 9/2024 Comerford ..... B65D 5/5045

FOREIGN PATENT DOCUMENTS

JP H07205989 A * 8/1995
JP 2955534 B2 * 10/1999
JP 2001039436 A * 2/2001
JP 2010-195426 A 9/2010
JP 3194333 U 10/2014
JP 2021041964 A * 3/2021

* cited by examiner

PACKING MEMBER AND PACKING MATERIAL THEREWITH

INCORPORATION BY REFERENCE

This application is based on and claims the benefit of priority from Japanese Patent Application No. 2024-060907 filed on Apr. 4, 2024, the contents of which are hereby incorporated by reference.

BACKGROUND

The present disclosure relates to a packing member for packing and also protecting a product.

Conventionally, some electronic devices and the like have a mechanically weak part (fragile part), such as a movable part, protruding forward or having a level difference. In such cases, common packing methods may be ineffective in protecting the fragile part from breakage or failure caused by vibration or the like during transportation.

The movable part can be enclosed in a spacer or the level difference can be filled with a spacer as a way of protection. This, however, increases the number of members and complicates the packing or unpacking processes. In addition, after unpacking, the protection member used only during transportation becomes useless and thus has to be disposed of. In view of decreasing the environmental load, it is preferable to reduce the number of members as far as possible.

SUMMARY

According to one aspect of the present disclosure, a packing member includes a body portion and a shock absorbing member. The body portion includes a bottom face portion that is rectangular in shape and on which a packed article is placed, and a side face portion that is provided continuously with the bottom face portion via folding lines along its three sides. The body portion is assembled by folding a piece of sheet. The shock absorbing member is disposed along one side of the body portion along which the side face portion is not provided continuously with it. The shock absorbing member has a holding structure that keeps the side face portion upright relative to the bottom face portion.

DETAILED DESCRIPTION

Figure 1:
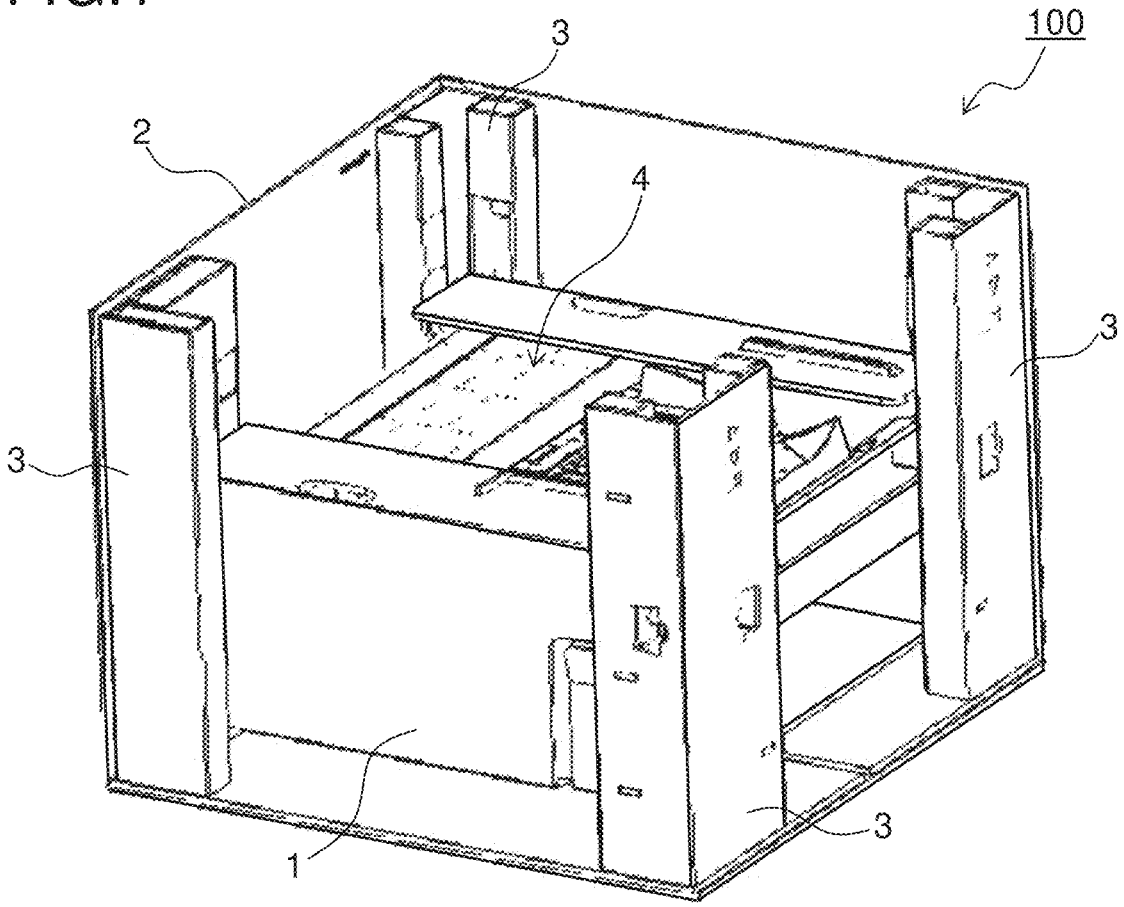
FIG. 1 is a perspective view of a packing material including a packing member according to an embodiment of the present disclosure.

Now, an embodiment of the present disclosure will be described with reference to the accompanying drawings. FIG. 1 is a perspective view of a packing material 100 including a packing member 1 according to an embodiment of the present disclosure. Note that, for convenience of description, in FIG. 1, of an outer case 2, a top face portion and two side face portions at the front are omitted. As shown in FIG. 1, the packing material 100 includes the packing member 1, the outer case 2, and a pillar member 3.

The packing member 1 is an inner case (product tray) that packs a product 4 (packed article). The packing member 1 also functions as a protection member that protects the product 4. A configuration of the packing member 1 will be described in detail later.

The outer case 2 is in the shape of a rectangular parallelepiped open at its top face and covers the bottom face, the side faces, and the top face of the packing member 1 that packs the product 4. Note that, while the embodiment uses an outer case 2 of which a bottom face portion, side face portions, and a top face portion are unitarily formed, it is also possible to use an outer case 2 that can separate into an outer case body having a bottom face portion and side face portions and a lid portion as a top face portion.

The pillar member 3 is disposed in a gap between each of the four corners of the outer case 2 and corresponding corner parts of the packing member 1, and protects the product 4 from an external shock. The pillar member 3 also has function to increase strength against pressure in a stack of the packing material 100. The pillar member 3 is formed by folding a cardboard sheet into a predetermined shape.

Figure 2:
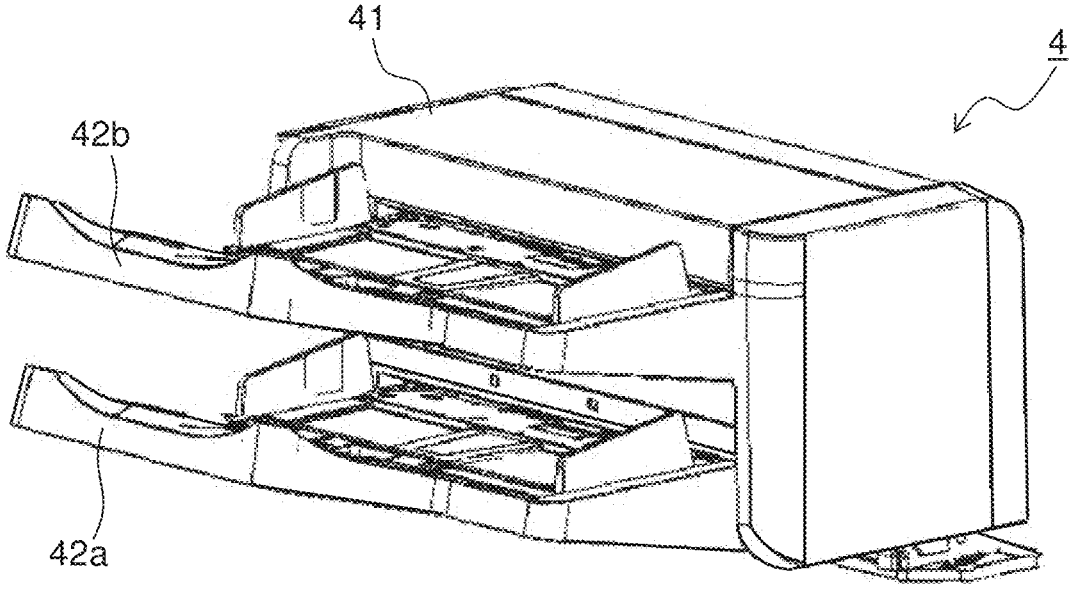
FIG. 2 is a perspective view of an example of a product to be packed with the packing member according to the embodiment.

FIG. 2 is a perspective view of an example of the product 4 to be packed with the packing member 1 according to the embodiment. The embodiment takes, as the product 4, a sheet discharging device. The product 4 has a device body 41 and sheet discharging trays 42*a* and 42*b*. The sheet discharging trays 42*a* and 42*b* protrude from one side face of the device body 41 (the near left side in FIG. 2) so as to overlap with each other in the top-bottom direction. Tip parts of the sheet discharging trays 42*a* and 42*b* are swingable in the top-bottom direction.

Figure 3:
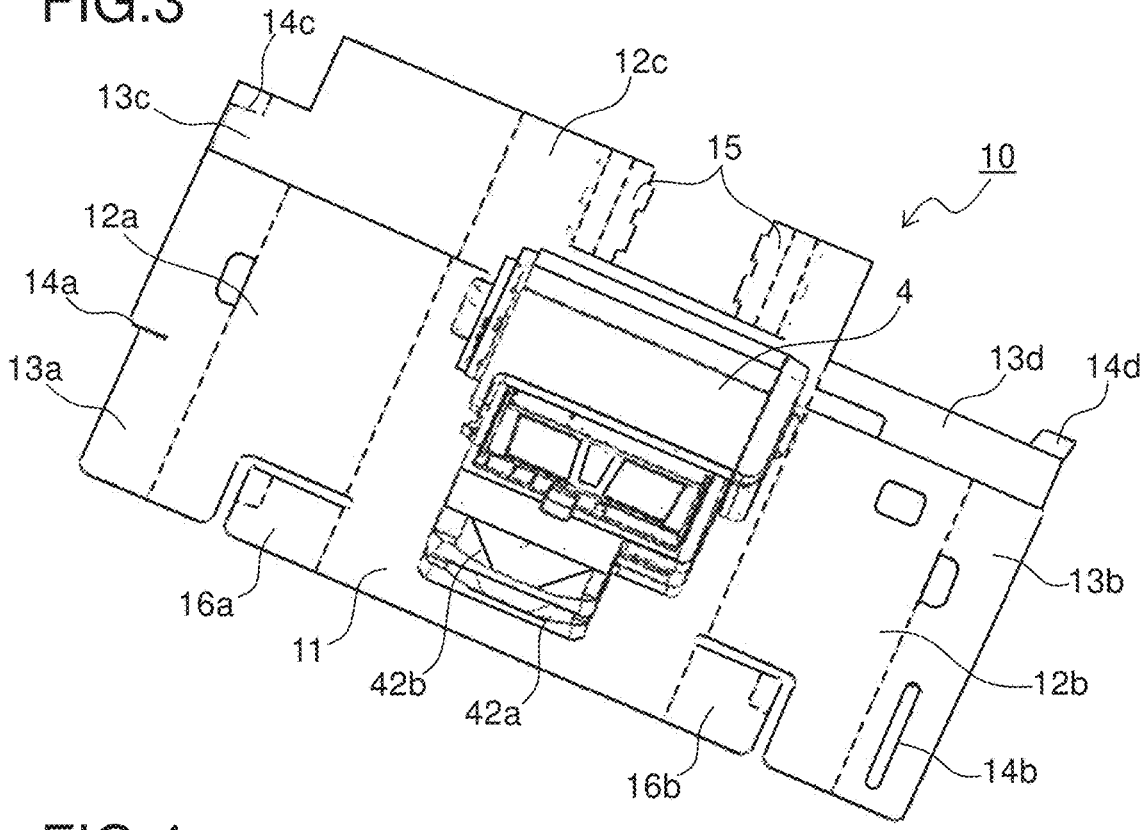
FIG. 3 is a plan view of the product placed on a bottom face portion of a body portion of the packing member according to the embodiment.

FIG. 3 is a plan view of the product 4 placed on a bottom face portion 11 of a body portion 10 of the packing member 1 according to the embodiment. In FIG. 3, and also in FIG. 4, which will be referred to later, cutting lines are indicated by solid lines and folding lines by broken lines. The packing member 1 has the body portion 10 and a first to a third shock absorbing member 17 to 19 (see FIG. 4).

The body portion 10 has the bottom face portion 11 and a first to a third side face portion 12*a* to 12*c*. The bottom face portion 11 is rectangular in shape and the product 4 is placed on it. The first and second side face portions 12*a* and 12*b* are provided continuously with the bottom face portion 11 via folding lines along two opposite sides of it. The third side face portion 12*c* is provided continuously with the bottom face portion 11 via a folding line along another side of it.

Along the sides of the first and second side face portions 12*a* and 12*b* opposite from the bottom face portion 11 (i.e., their top sides after assembly), a first and a second flap 13*a* and 13*b* are provided continuously with them via folding lines, respectively. The first and second flaps 13*a* and 13*b* have a first and a second cut portion 14*a* and 14*b* formed in them, respectively.

Along the two sides of the third side face portion 12*c* orthogonal to the bottom face portion 11 (i.e., the right and left sides after assembly), a third and a fourth flap 13*c* and 13*d* are provided continuously with it via folding lines. The third and fourth flaps 13*c* and 13*d* have a first and a second insert segment 14*c* and 14*d* formed on them, respectively.

In a middle part of the third side face portion 12*c*, a shock absorbing structure forming portion 15 is formed that has a plurality of folding lines. Folding the shock absorbing structure forming portion 15 along the folding lines into the shape of a rectangular tube forms a shock absorbing structure for protecting the product 4 from a shock.

With the two sides of the bottom face portion 11 with which the first and second side face portions 12*a* and 12*b* are provided continuously, shock absorbing member fixing segments 16*a* and 16*b* are provided continuously via folding lines.

Figure 4:
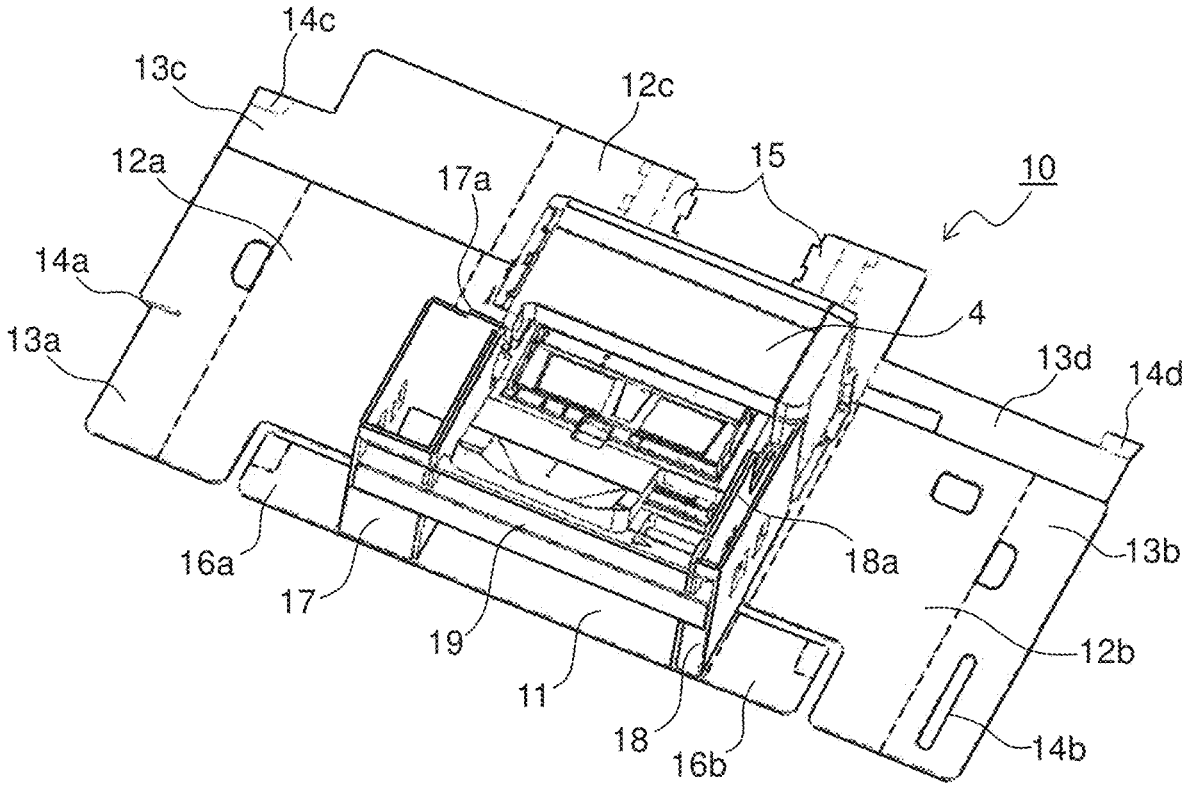
FIG. 4 is a perspective view of the state where, as compared with the state shown in FIG. 3, first to third shock absorbing members are placed around sheet discharging trays of the product.
Figure 5:
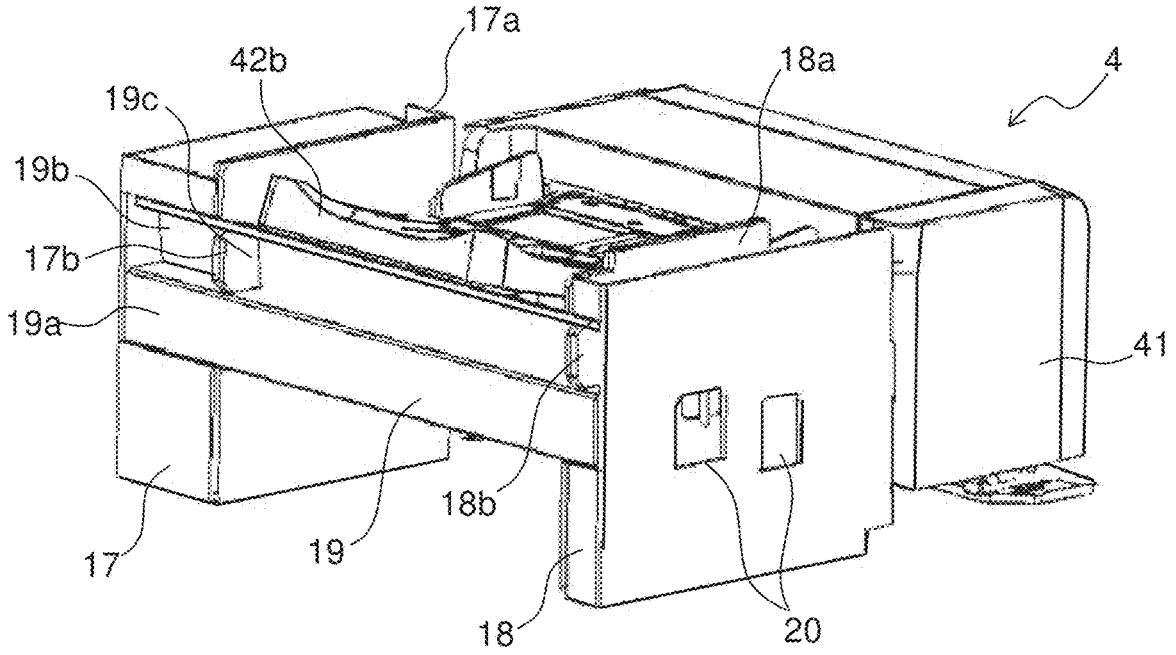
FIG. 5 is a perspective view of the product and the first to third shock absorbing members in FIG. 4.
Figure 6:
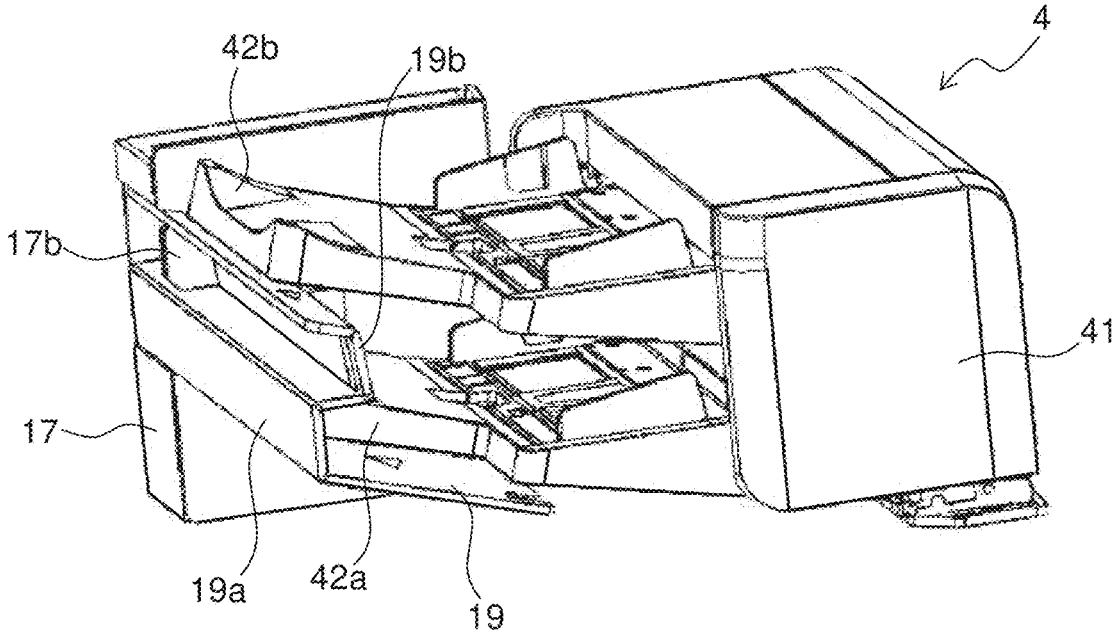
FIG. 6 is a perspective view of the state where, as compared with the state shown in FIG. 5, the second shock absorbing member is removed.
Figure 7:
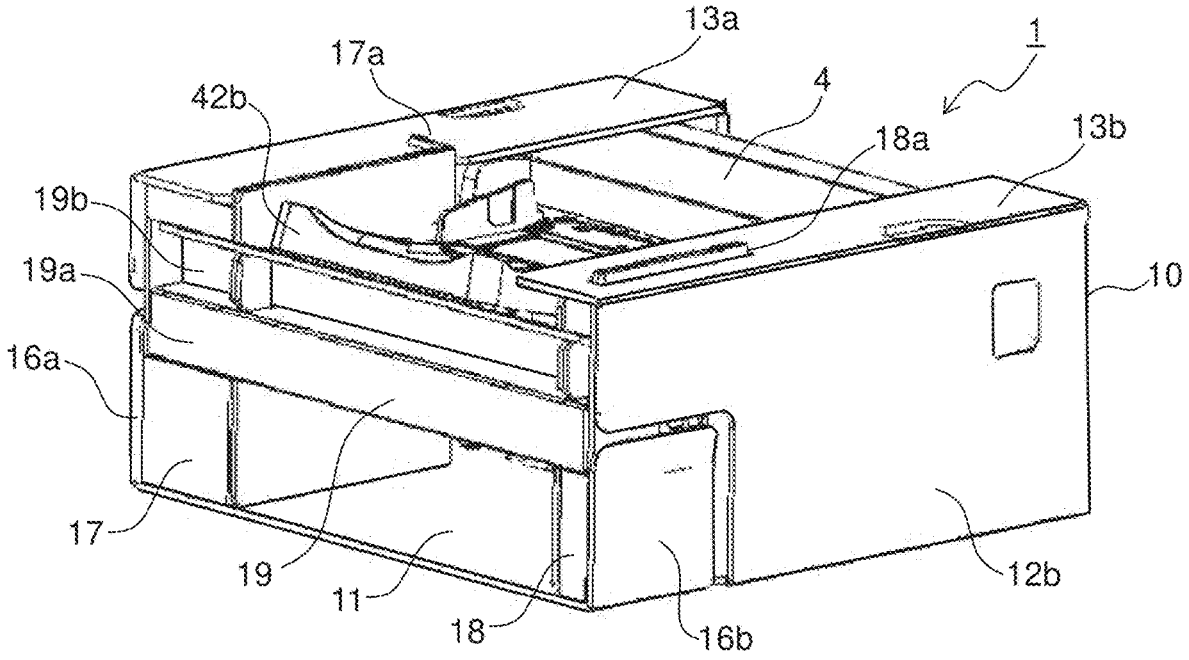
FIG. 7 is a perspective view of the product packed in the packing member.

FIG. 4 is a perspective view of the state where, as compared with the state shown in FIG. 3, the first to third shock absorbing members 17 to 19 are placed around the sheet discharging trays 42*a* and 42*b* of the product 4. FIG. 5 is a perspective view of the product 4 and the first to third shock absorbing members 17 to 19 in FIG. 4. FIG. 6 is a perspective view of the state where, as compared with the state shown in FIG. 5, the second shock absorbing member 18 is removed.

The first and second shock absorbing members 17 and 18 are each formed by folding a cardboard sheet into the shape of a rectangular tube. The first and second shock absorbing members 17 and 18 are disposed along the sides of the sheet discharging trays 42*a* and 42*b* so as to protect the sheet discharging trays 42*a* and 42*b* from an external shock. The first and second shock absorbing members 17 and 18 are disposed so as to protrude outward beyond the device body 41 of the product 4 to protect the device body 41 from an external shock.

As shown in FIG. 5, in top end parts of the first and second shock absorbing members 17 and 18, a first and a second engagement portion 17*a* and 18*a* are formed, respectively. In side end parts of the first and second shock absorbing members 17 and 18 (end parts in the protruding direction of the sheet discharging trays 42*a* and 42*b*), a first and a second projection portion 17*b* and 18*b* are formed, respectively. In side face portions of the first and second shock absorbing members 17 and 18 (their faces opposite the first and second side face portions 12*a* and 12*b*), insertion holes 20 are formed. Note that, in FIG. 5, the insertion holes 20 in the first shock absorbing member 17 are not illustrated.

As shown in FIG. 6, the third shock absorbing member 19 is formed by folding a cardboard sheet multiple times (in the embodiment, two times) into a U-shape as seen from a side face. The third shock absorbing member 19 has a first and a second bent portion 19*a* and 19*b*. The first bent portion 19*a* is in a convex shape protruding outward of the packing member 1. The second bent portion 19*b* is formed above the first bent portion 19*a*, adjacent to it, and is in a convex shape protruding inward of the packing member 1. The second bent portion 19*b* has a slit 19*c* formed in it into which the first and second projection portion 17*b* and 18*b* are inserted.

Now, the sequence of the assembly of the packing member 1 will be described. First, as shown in FIG. 3, the product 4 is placed on the bottom face portion 11 of the body portion 10. Specifically, the product 4 is placed such that its sheet discharging trays 42*a* and 42*b* face the side of the bottom face portion 11 along which the first to third side face portions 12*a* to 12*c* are not provided continuously.

Next, as shown in FIGS. 4 to 6, the first to third shock absorbing members 17 to 19 are disposed around the sheet discharging trays 42*a* and 42*b*. Specifically, along sides of the sheet discharging trays 42*a* and 42*b* of the product 4, the first and second shock absorbing members 17 and 18 are disposed. Then, the third shock absorbing member 19 is disposed between the first and second shock absorbing members 17 and 18. As shown in FIG. 6, the first bent portion 19*a* of the third shock absorbing member 19 covers the tip part of the sheet discharging tray 42*a* and the second bent portion 19*b* is inserted into the gap between the sheet discharging trays 42*a* and 42*b*.

Then, into the slit 19*c* in the third shock absorbing member 19, the first projection portion 17*b* of the first shock absorbing member 17 and the second projection portion 18*b* of the second shock absorbing member 18 are inserted. The third shock absorbing member 19 is thus fixed to the first and second shock absorbing members 17 and 18 so as to bridge between them.

Next, of the body portion 10, the shock absorbing structure forming portion 15 of the third side face portion 12*c* is bent along folding lines to form a shock absorbing structure. Then, the first to third side face portions 12*a* to 12*c* are raised upright vertically from three sides of the bottom face portion 11. Meanwhile, the third and fourth flaps 13*c* and 13*d* provided continuously with the third side face portion 12*c* are bent inward to overlap with the inner faces in the first and second side face portions 12*a* and 12*b*. Then, the first insert segment 14*c* of the third flap 13*c* and the second insert segment 14*d* of the fourth flap 13*d* are inserted into the insertion holes 20 in the first and second shock absorbing members 17 and 18, respectively. This keeps the third side face portion 12*c* upright.

Further, the shock absorbing member fixing segments 16*a* and 16*b* are bent upright relative to the bottom face portion 11 and are inserted into the insertion holes 20 of the first and second shock absorbing members 17 and 18 so as to be fixed to these. The first and second shock absorbing members 17 and 18 are thus positioned with respect to the bottom face portion 11.

Finally, the first flap 13*a* provided continuously with the first side face portion 12*a* and the second flap 13*b* provided continuously with the second side face portion 12*b* are bent inward. Then, the first and second cut portions 14*a* and 14*b* are engaged with the first engagement portion 17*a* of the first shock absorbing member 17 and the second engagement portion 18*a* of the second shock absorbing member 18, respectively. This keeps the first and second side face portions 12*a* and 12*b* upright. The first and second engagement portions 17*a* and 18*a* and the insertion holes 20 are a holding structure that keeps the first to third side face portions 12*a* to 12*c* upright relative to the bottom face portion 11.

The thus assembled packing member 1 is placed in the outer case 2 and, with the pillar members 3 inserted in the gaps between the packing member 1 and the outer case 2, the outer case 2 is closed. In this way, the product 4 is packed in the packing material 100.

With the packing member 1 according to the embodiment, the first to third side face portions 12*a* to 12*c* face the product 4 from three directions except the protruding direction of its sheet discharging trays 42*a* and 42*b*, and in the protruding direction of the sheet discharging trays 42*a* and 42*b*, the first to third shock absorbing members 17 to 19 are disposed. The first and second shock absorbing members 17 and 18 have the first and second engagement portions 17*a* and 18*a* and the insertion holes 20 with which they keep the first to third side face portions 12*a* to 12*c* upright relative to the bottom face portion 11.

Thus, the sheet discharging trays 42*a* and 42*b*, which are susceptible to vibration and a shock in the top-bottom direction, are held by the first and second bent portions 19*a* and 19*b* of the third shock absorbing member 19, and this helps prevent breakage of the sheet discharging trays 42*a* and 42*b*. In other words, it is possible to effectively protect, from an external shock, the product 4 that has a fragile part (the sheet discharging trays 42*a* and 42*b*) that has a multilayer structure in one direction.

The packing member 1 is configured by raising the first to third side face portions 12*a* to 12*c* of the body portion 10 from three directions and using, as the side face pointing in the remaining direction, a member separate from the body portion 10 (the first to third shock absorbing members 17 to 19). This allows the product 4 to be placed, with the body portion 10 unfolded, on the bottom face portion 11 from the direction in which the first to third side face portions 12*a* to 12*c* are not formed. This eliminates the need for one to stretch one's arms far to place the product 4 on the bottom face portion 11, improving ease of assembly.

Moreover, the first and second shock absorbing members 17 and 18 are disposed so as to protrude outward beyond the device body 41 of the product 4 and the shock absorbing structure forming portion 15 is provided in the third side face portion 12*c*. This helps effectively protect the product 4 from an external shock from the three directions except the protruding direction of the sheet discharging trays 42*a* and 42*b*.

The above embodiment is not meant as any limitation on the present disclosure and thus various modifications can be made without departing from the spirit of the present disclosure. For example, in the above embodiment, the first and second bent portions 19*a* and 19*b* are formed by bending the third shock absorbing member 19 two times into a U-shape as seen from a side face. The number of times of bending, however, can be changed to suit application to a product 4 that has a fragile part that has a structure with a single layer or three or more layers.

While, the above embodiment takes, as an example of the product 4 to be packed with the packing member 1, a sheet discharging device, the packing member 1 according to the present disclosure finds application quite equally in, any products 4 other than sheet discharging devices if they have a fragile part in one direction.

While, in the above embodiment, the description is given of the packing material 100 including the packing member 1, the outer case 2, and the pillar member 3, the packing material 100 can include other components. For example, a shock absorbing member can be disposed between the top face of the packing member 1 and the top face portion of the outer case 2.

The present disclosure finds applications in packing members for packing and also protecting a product. Based on the present disclosure, it is possible to provide a packing member and a packing material including the same that help protect a packed article that has a fragile part in one direction while allowing easy packing.

What is claimed is:

1. A packing member comprising:

a body portion including a bottom face portion that is rectangular in shape and on which a packed article is placed, and a side face portion that is provided continuously with the bottom face portion via folding lines along three sides of the bottom face portion, the body portion being assembled by folding a piece of sheet; and a shock absorbing member disposed along one side of the body portion along which the side face portion is not provided continuously therewith, wherein the shock absorbing member has a holding structure that keeps the side face portion upright relative to the bottom face portion, the side face portion is configured with:

first and second side face portions that are provided continuously with the bottom face portion via folding lines along two opposite sides of the bottom face portion; and a third side face portion that is provided continuously with the bottom face portion via a folding line along another side of the bottom face portion, and the shock absorbing member includes:

a first shock absorbing member disposed along an inner face of the first side face portion;

a second shock absorbing member disposed along an inner face of the second side face portion; and a third shock absorbing member fixed to the first and the second shock absorbing members so as to bridge between the first and second shock absorbing members.

2. The packing member according to claim 1, wherein the packed article has a fragile part that has a multilayer structure in one direction among horizontal directions, the third shock absorbing member has one or more bent portions formed in a U-shape as seen from a side face, the bent portions being arranged adjacent to each other in a top-bottom direction, and the bent portions are inserted into a gap in the fragile part.

3. The packing member according to claim 1, wherein along sides of the first and the second side face portions opposite from the bottom face portion, first and second flaps are provided continuously with the first and the second side face portions via folding lines, and the holding structure is configured with:

a cut portion formed in the first and the second flaps; and an engagement portion formed in the first and the second shock absorbing members, the engagement portion being inserted into the cut portion.

4. The packing member according to claim 1, wherein along two sides of the third side face portion orthogonal to the bottom face portion, third and fourth flaps are provided continuously with the third side face portion via folding lines, and the holding structure is configured with:

an insert segment formed in the third and the fourth flaps; and an insertion hole formed in the first and the second shock absorbing members, the insert segment being inserted into the insertion hole.

5. The packing member according to claim 1, wherein in the third side face portion, a shock absorbing structure forming portion is formed that has a plurality of folding lines and folding the shock absorbing structure forming portion along the folding lines into a shape of a rectangular tube forms a shock absorbing structure for protecting the packed article from a shock.

6. The packing member according to claim 1, wherein with two sides of the body portion with which the first and the second side face portions are provided continuously, shock absorbing member fixing segments are provided continuously via folding lines, the shock absorbing member fixing segments being engaged with the first and the second shock absorbing members.

7. A packing material comprising:

the packing member according to claim 1;

an outer case in which the packing member is housed; and a pillar member disposed in a gap between the packing member and the outer case.

* * * * *